US005405138A

United States Patent [19]

Duran

[11] Patent Number: 5,405,138

[45] Date of Patent: Apr. 11, 1995

[54] SPORT SWING TRAINING AID

[76] Inventor: Anthony P. Duran, 135 Main St., Depew, N.Y. 14043

[21] Appl. No.: 95,070

[22] Filed: Jul. 20, 1993

[51] Int. Cl.[6] ..... A63B 69/36

[52] U.S. Cl. ..... 273/186.2; 273/26 B; 273/73 R

[58] Field of Search ..... 273/186.2, 183.1, 26 B, 273/29 R, 72 A, 72 R, 67 R, 73; 446/204

[56] References Cited

U.S. PATENT DOCUMENTS

| | | | |
|---|---|---|---|
| 1,113,162 | 10/1914 | Murphy | 446/204 |
| 3,136,546 | 6/1964 | Connolly | 273/26 B |
| 3,236,521 | 2/1966 | Knott | 273/26 B |
| 4,283,057 | 8/1981 | Ragan | 273/186.2 |
| 5,014,984 | 5/1991 | Brockhoff | 273/67 R |

OTHER PUBLICATIONS

See description and photographs of prior device on attached sheets.

*Primary Examiner*—Mark S. Graham
*Attorney, Agent, or Firm*—Joseph P. Gastel

[57] ABSTRACT

A sport swing training aid for practicing the swing of a ball-hitting device including an elongated rod-like member having a first end for being gripped and a second end remote from the first end representing a ball-striking surface, the rod-like member being hollow and internally corrugated and being capable of producing a tone as air passes through the member during the swinging thereof to produce a tone which varies in length and pitch in direct proportion with the velocity and duration of the movement of the ball-striking end as it is swung through a ball-striking zone, to thereby provide an audible feedback to the player as to the tempo and rhythm of the swing.

3 Claims, 2 Drawing Sheets

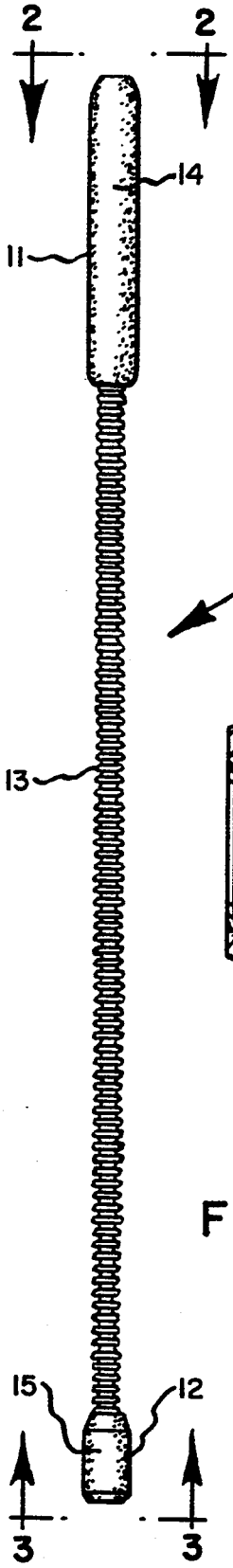
Fig. 1.
Fig. 2.
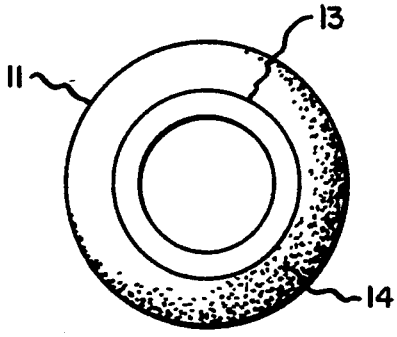
Fig. 3.
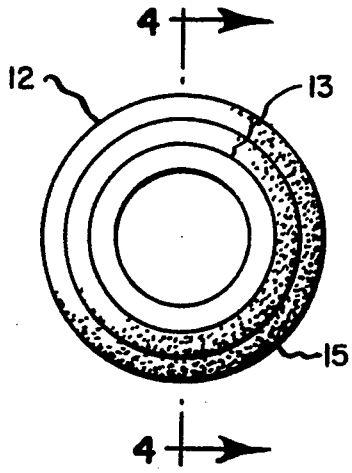
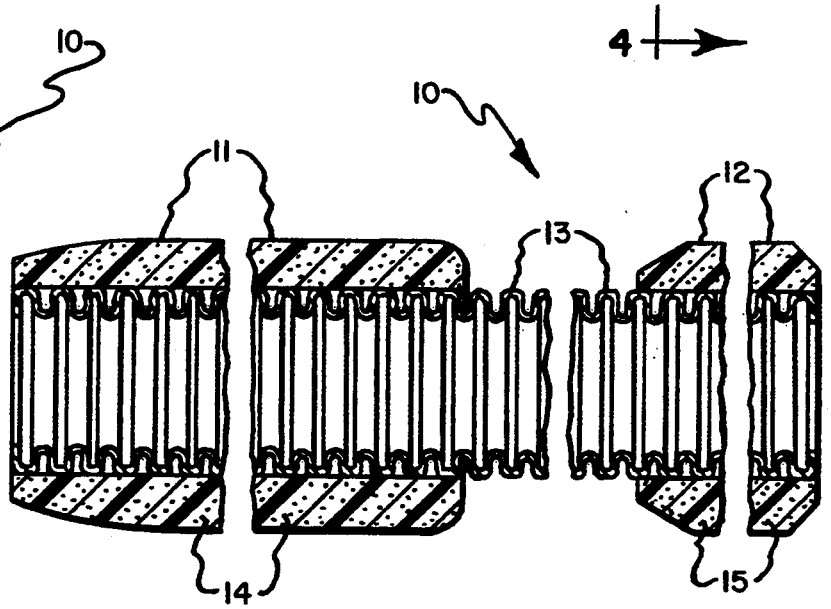
Fig. 4.
Fig. 5.
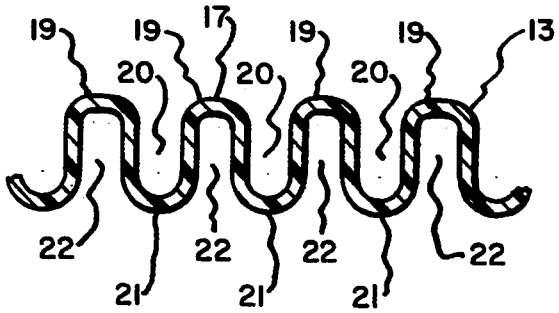

Fig. 6.
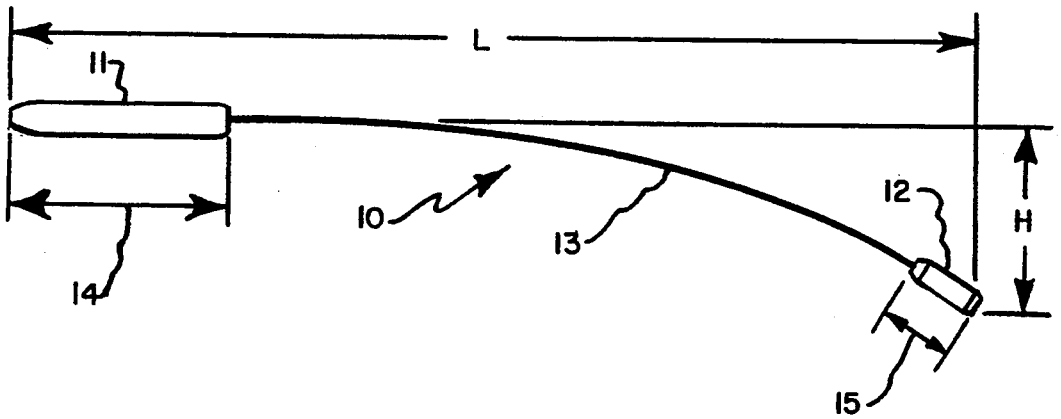
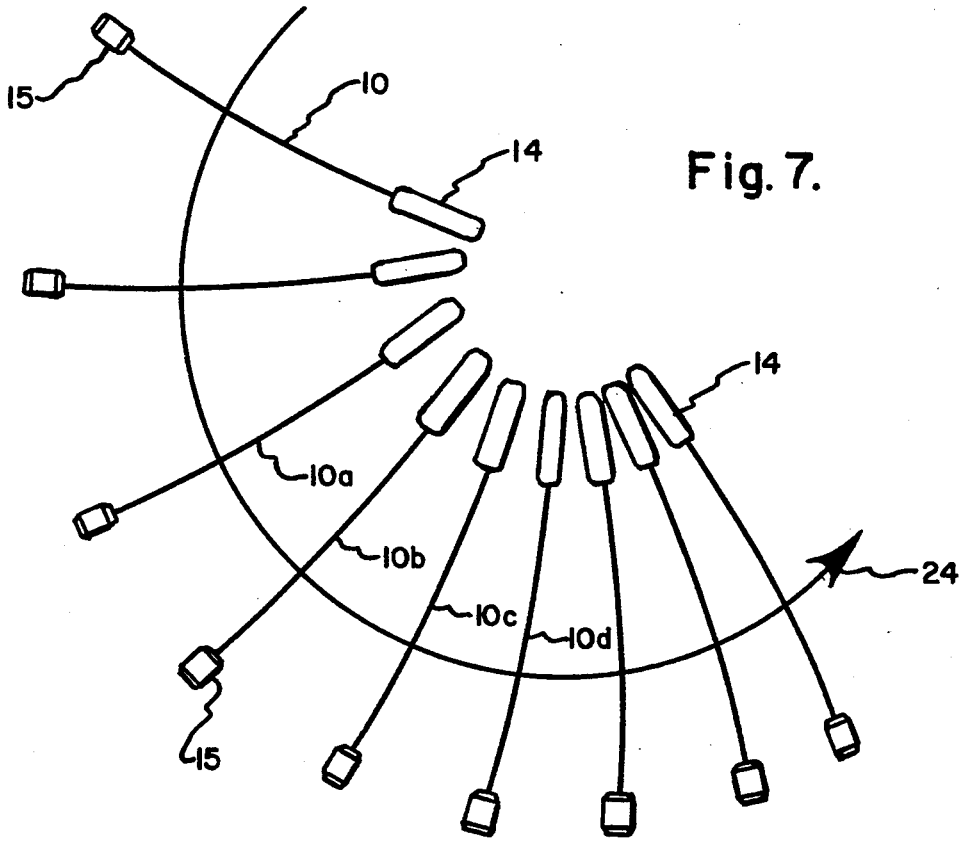
Fig. 7.

SPORT SWING TRAINING AID

BACKGROUND OF THE INVENTION

The present invention relates to a sport swing training aid for practicing the swing of a ball-hitting device.

By way of background, in all sports wherein a rod-like member, such as a golf club, baseball bat or tennis racket, is used to strike a ball, the quality of the swing depends on the proper tempo and rhythm provided by the player.

SUMMARY OF THE INVENTION

It is the object of the present invention to provide a sport swing training aid for practicing the swing of a ball-hitting device which teaches the proper tempo and rhythm of a smooth powerful swing by providing a special audible feedback to the player when the swing is at an optimum value.

Another object of the present invention is to provide a sport swing training aid for practicing the swing of a ball-hitting device wherein the swing can be practiced anywhere that there is enough space, such as in an office or outdoors without requiring the use of the actual ball-hitting device.

A further object of the present invention is to provide a sport swing training aid for practicing the swing of a ball-hitting device which can be used for warming up and limbering the muscles prior to actually engaging in the sport. Other objects and attendant advantages of the present invention will readily be perceived hereafter.

The present invention relates to a sport swing training aid for practicing the swing of a ball-hitting device comprising an elongated rod-like member having a first end for being gripped and a second end remote from said first end representing a ball-striking surface, and tone-producing means on said member for producing an audible tone which varies in length and pitch in direct proportion to the velocity and duration of movement of said remote end as it is swung through a ball-striking zone, whereby audible feedback can be obtained as to the tempo and rhythm of the swing.

The various aspects of the present invention will be more fully understood when the following portions of the specification are read in conjunction with the accompanying drawings wherein:

BRIEF DESCRIPTION OF THE DRAWINGS

FIG. 1 is a side elevational view of the sport swing training aid of the present invention;

FIG. 2 is an end elevational view taken substantially in the direction of arrows 2—2 of FIG. 1;

FIG. 3 is an end elevational view taken substantially in the direction of arrows 3—3 of FIG. 1;

FIG. 4 is a fragmentary cross sectional view taken substantially along line 4—4 of FIG. 2;

FIG. 5 is a fragmentary enlarged cross sectional view of the configuration of the wall of the tubular rod-like member;

FIG. 6 is a schematic view showing the inherent flexibility of the rod-like member; and FIG. 7 is a schematic view showing the acceleration of the rod-like member through a ball hitting zone which provides the higher pitch and length of duration of the tone produced by the member.

DESCRIPTION OF THE PREFERRED EMBODIMENTS

The sport swing training aid for practicing the swing of a ball-hitting device, in this instance a golf club, comprises a rod-like member 10 having a grip end 11, and a remote end 12 representative of a ball-striking surface. The rod-like member 10 includes an elongated hollow ribbed tubular plastic member 13 which is slightly flexible. An annular foam plastic grip 14 is mounted on one end of member 13, and a shorter like annular foam member 15 is mounted on the other end and represents a ball-striking surface.

The tubular plastic member 13 has an annular wall 17 which is corrugated in that it has external ridges 19 alternating with external grooves 20, and it has internal ridges 21 alternating with internal grooves 22. The ridges 19 and 21 extend perpendicularly to the longitudinal axis of member 13 and they are spaced from each other by the grooves. The ridges 19 are not helical; they are separate spaced ridges. The same is true of internal ridges 21 which lie directly opposite to grooves 20. The tubular member 13 is commercially available and is known as CARLON FLEX PLUS ribbed electrical nonmetallic tubing.

In FIG. 6 the physical characteristics of the sport swing training aid 10 are shown. The overall length L is 40 inches. The length of grip 14 is $8\frac{1}{2}$ inches. The length of foam member 15 is $2\frac{3}{8}$ inches. The outer diameter of member 13 is $\frac{7}{8}$ inches; the inner diameter of member 13 is $\frac{1}{2}$ inch, and the ribs are approximately 1/16 of an inch wide. When the grip 14 is held horizontally and the rod 13 is permitted to flex of its own weight, there will be a drop of the ball-striking portion 15 in an amount H of approximately $7\frac{1}{2}$ inches. It will be appreciated that the stiffness of member 13 can be varied to simulate shafts of different stiffness.

As noted above, the purpose of the sport swing training aid 10 is to develop good tempo and rhythm to provide a smooth powerful swing of a golf club, in this instance. The reason that the sport swing training aid provides the foregoing result is because the proper swing can be detected audibly. In this respect, as the training aid 10 is swung in the path of a golf swing, it generates a higher tone as the ball-striking surface 15 passes through the ball-striking zone. The higher the pitch of this tone and the longer its duration through the ball-hitting zone, the better is the golf swing. This can be explained more readily by the schematic representation of FIG. 7 wherein the various positions of the rod-like member 10 are shown as it is swung in the direction of arrow 24 toward a ball. It can readily be seen that at positions between **10*a*, 10*b*, 10*c* and 10*d* there is an acceleration of the ball-striking surface 15 due to the wrist action of the golfer. The longer that the tone occurs and the higher the pitch as the rod 13** passes through the ball-striking zone, the better is the rhythm and tempo resulting from the entire swing. This tone is an audible feedback to the golfer. Thus, the golfer can audibly detect a good tempo and rhythm to provide the proper timing for a smooth powerful swing.

The above principles applied to a golf swing are equally applicable to other ball or projectile hitting devices including a baseball bat and a tennis racket. In fact, it is believed that the sport training aid can be used in any sport wherein a ball or projectile is struck by a rod-like member or a member which acts like a rod-like member. It will also be appreciated that the length of the member 10 can be varied to represent the rod-like members used in different sports and, further, the stiffness of the member can be varied. For baseball and tennis a member like member 10 is used, with the only difference being that the member is 30 inches long.

It is believed that the tone is generated as air is forced through the hollow member 13, and more specifically it is believed that it is caused by the internal ribbing. It is also contemplated that the tone can also be generated by placing a suitably shaped orifice in a hollow member so that as air rushes therethrough, a tone will be generated.

While preferred embodiments of the present invention have been disclosed, it will be appreciated that it is not limited thereto but may be otherwise embodied within the scope of the following claims.

What is claimed is:

1. A sport swing training aid for practicing the swing of a ball-hitting device comprising an elongated slightly flexible hollow rod-like member having a first end for being gripped and a second end remote from said first end representing a ball-striking surface, and tone-producing means in said hollow rod-like member for producing an audible tone which varies in length and pitch in direct proportion to the velocity and duration of movement of said remote end as it is swung through a ball-striking zone, whereby audible feedback can be obtained as to the tempo and rhythm of the swing, said tone-producing means comprising internal ridges within said hollow rod-like member, said elongated hollow rod-like member also including external ridges on the outer surface thereof, and said internal and external ridges extending transversely to the longitudinal axis of said elongated rod-like member.

2. A sport swing training aid for practicing the swing of a ball-hitting device comprising an elongated slightly flexible hollow rod-like member having a first end for being gripped and a second end remote from said first end representing a ball-striking surface, and tone-producing means in said hollow rod-like member for producing an audible tone which varies in length and pitch in direct proportion to the velocity and duration of movement of said remote end as it is swung through a ball-striking zone, whereby audible feedback can be obtained as to the tempo and rhythm of the swing, said tone-producing means comprising internal ridges within said hollow rod-like member, and said internal ridges extending transversely to the longitudinal axis of said hollow elongated rod-like member.

3. A sport swing training aid for practicing the swing of a ball-hitting device comprising an elongated slightly flexible hollow rod-like member having a first end for being gripped and a second end remote from said first end representing a ball-striking surface, and tone-producing means in said hollow rod-like member for producing an audible tone which varies in length and pitch in direct proportion to the velocity and duration of movement of said remote end as it is swung through a ball-striking zone, whereby audible feedback can be obtained as to the tempo and rhythm of the swing, said slightly flexible hollow rod-like member being of substantially uniform cross-sectional outer diameter substantially throughout its length, and said tone-producing means comprising internal ridges within said hollow rod-like member, and said internal ridges extending transversely to the longitudinal axis of and substantially throughout the length of said elongated slightly flexible hollow rod-like member.

* * * * *